US007444767B2

(12) United States Patent
Kilgore et al.

(10) Patent No.: US 7,444,767 B2
(45) Date of Patent: Nov. 4, 2008

(54) ARTICLE OF FOOTWEAR WITH MIDSOLE HAVING HIGHER DENSITY PERIPHERAL PORTION

(75) Inventors: Bruce J. Kilgore, Lake Oswego, OR (US); Greg Leedy, Milwaukie, OR (US); Michael A. Calvano, Tualatin, OR (US); Michael Hui, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 416 days.

(21) Appl. No.: 11/274,751

(22) Filed: Nov. 15, 2005

(65) Prior Publication Data

US 2007/0107259 A1 May 17, 2007

(51) Int. Cl.
*A43B 13/14* (2006.01)
*A43B 13/18* (2006.01)

(52) U.S. Cl. ..... 36/30 R; 36/28; 36/31

(58) Field of Classification Search ..... 36/30 R, 36/28, 31, 25 R
See application file for complete search history.

(56) References Cited

U.S. PATENT DOCUMENTS

| | | | | |
|---|---|---|---|---|
| 2,410,019 | A | | 10/1946 | Davis |
| 4,302,892 | A | | 12/1981 | Adamik |
| 4,364,188 | A | | 12/1982 | Turner et al. |
| 4,364,189 | A | | 12/1982 | Bates |
| 4,398,357 | A | | 8/1983 | Batra |
| 4,506,462 | A | * | 3/1985 | Cavanagh ..... 36/92 |
| 4,547,979 | A | | 10/1985 | Harada et al. |
| 4,551,930 | A | | 11/1985 | Graham et al. |
| 4,557,060 | A | | 12/1985 | Kawashima |
| 4,624,061 | A | * | 11/1986 | Wezel et al. ..... 36/30 A |
| 4,642,911 | A | | 2/1987 | Talarico, II |
| 4,654,983 | A | | 4/1987 | Graham et al. |
| 4,667,423 | A | | 5/1987 | Autry et al. |
| 4,730,402 | A | | 3/1988 | Norton et al. |
| 4,759,136 | A | | 7/1988 | Stewart et al. |
| 4,766,679 | A | | 8/1988 | Bender |
| 4,876,053 | A | | 10/1989 | Norton et al. |

(Continued)

FOREIGN PATENT DOCUMENTS

DE 202004016192 U1 1/2005

(Continued)

OTHER PUBLICATIONS

International Search Report PCT/US2006/060861.

*Primary Examiner*—Ted Kavanaugh
(74) *Attorney, Agent, or Firm*—Banner & Witcoff, Ltd.

(57) ABSTRACT

An article of footwear includes an upper and a sole assembly. The sole assembly includes a central member of a first material having a first density with its medial and lateral sides having surface irregularities. A medial member extends along a medial side of the central member and beneath a portion of the central member, and has a surface irregularity configured to mate and interlock with a surface irregularity of the central member. The medial member is formed of a second material having a density greater than the first density. A lateral member extends along a lateral side of the central member and beneath a portion of the central member, and has a surface irregularity configured to mate and interlock with a surface irregularity of the central member. The lateral member is formed of a third material having a density greater than the first density.

23 Claims, 3 Drawing Sheets

U.S. PATENT DOCUMENTS

| | | | | |
|---|---|---|---|---|
| 5,025,573 | A | | 6/1991 | Giese et al. |
| 5,141,578 | A | | 8/1992 | Yang |
| 5,308,420 | A | | 5/1994 | Yang |
| 5,318,645 | A | | 6/1994 | Yang |
| 5,325,611 | A | | 7/1994 | Dyer et al. |
| 5,362,435 | A | | 11/1994 | Volpe |
| 5,396,675 | A | | 3/1995 | Vincent et al. |
| 5,435,077 | A | | 7/1995 | Pyle |
| 5,435,078 | A | | 7/1995 | Pyle |
| 5,572,805 | A | | 11/1996 | Giese et al. |
| 5,575,089 | A | | 11/1996 | Giese et al. |
| 5,649,374 | A | * | 7/1997 | Chou ..... 36/27 |
| 5,787,610 | A | | 8/1998 | Brooks |
| RE35,905 | E | | 9/1998 | Vincent et al. |
| 5,921,004 | A | | 7/1999 | Lyden |
| 6,023,859 | A | | 2/2000 | Burke et al. |
| 6,061,929 | A | | 5/2000 | Ritter |
| 2003/0208930 | A1 | | 11/2003 | Swigart |
| 2004/0154188 | A1 | | 8/2004 | Laska |

FOREIGN PATENT DOCUMENTS

| | | | |
|---|---|---|---|
| EP | 1352579 | A1 | 10/2003 |

* cited by examiner

ARTICLE OF FOOTWEAR WITH MIDSOLE HAVING HIGHER DENSITY PERIPHERAL PORTION

FIELD OF THE INVENTION

This invention relates generally to an article of footwear and, in particular, to an article of footwear with a midsole having a peripheral portion having a greater density than a remainder of the midsole.

BACKGROUND OF THE INVENTION

A conventional article of athletic footwear includes two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower portion of the upper and is generally positioned between the foot and the ground. In addition to attenuating ground reaction forces (i.e., imparting cushioning), the sole structure may provide traction and control foot motions, such as pronation. Accordingly, the upper and the sole structure operate cooperatively to provide a comfortable structure that is suited for a variety of ambulatory activities, such as walking and running.

The sole structure of athletic footwear generally exhibits a layered configuration that may include a comfort-enhancing insole, a resilient midsole formed from a polymer foam material, and a ground-contacting outsole that provides both abrasion-resistance and traction. The midsole is the primary sole structure element that imparts cushioning and controls foot motions. Suitable polymer foam materials for the midsole include ethylvinylacetate or polyurethane, which compress resiliently under an applied load to attenuate ground reaction forces created by the impacts of running and jumping. Conventional polymer foam materials are resiliently compressible, in part, due to the inclusion of a plurality of open or closed cells that define an inner volume substantially displaced by gas. The polymer foam materials of the midsole may also absorb energy when compressed during ambulatory activities. The compression of the foam is affected by hysteresis loss, and deflection of such systems is affected by the volume of the compressed mass of the midsole.

It would be desirable to provide an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain embodiments.

SUMMARY

The principles of the invention may be used to advantage to provide an article of footwear with a midsole having a peripheral portion formed of a material having a greater density than a remaining portion of the midsole. In accordance with a first preferred aspect, an article of footwear includes an upper and a sole assembly secured to the upper. The sole assembly includes a central member formed of a first material having a first density and a medial member. extending along a portion of a medial side of the central member and beneath a portion of the central member. A medial side of the central member has a first surface irregularity, and a lateral side of the central member has a second surface irregularity. The medial member is formed of a second material having a density greater than the first density, and has a surface irregularity configured to mate and interlock with the first surface irregularity of the central member. A lateral member extends along a portion of a lateral side of the central member and beneath a portion of the central member, has a surface irregularity configured to mate and interlock with the second surface irregularity of the central member, and is formed of a third material having a density greater than the first density.

In accordance with another aspect, an article of footwear includes an upper and a sole assembly secured to the upper. The sole assembly includes a midsole having a central member formed of a first material having a first density. A medial side of the central member has a first surface irregularity, and a lateral side of the central member has a second surface irregularity. A medial member extends along a medial side of the central member and beneath a portion of the central member and has a surface irregularity configured to mate and interlock with the first surface irregularity of the central member. The medial member is formed of a second material having a second density, with the second density being greater than the first density. A lateral member extends along a lateral side of the central member and beneath a portion of the central member and has a surface irregularity configured to mate and interlock with the second surface irregularity of the central member. The lateral member is formed of the second material. An outsole is secured to the midsole.

In accordance with a further aspect, an article of footwear includes an upper and a sole assembly secured to the upper. The sole assembly includes a midsole having a central member formed of ethyl vinyl acetate and having a first density. A medial side of the central member has a first surface irregularity, and a lateral side of the central member has a second surface irregularity. A medial member extends along a medial side of the central member and beneath a portion of the central member and has a surface irregularity configured to mate and interlock with the first surface irregularity of the central member. The medial member is formed of ethyl vinyl acetate and has a second density, with the second density being greater than the first density. A lateral member extends along a lateral side of the central member and beneath a portion of the central member and has a surface irregularity configured to mate and interlock with the second surface irregularity of the central member. The lateral member is formed of ethyl vinyl acetate and has the second density. A recess is formed in an upper surface of the central member. A fluid-filled bladder is received in the recess in the central member. An outsole is secured to the midsole.

Substantial advantage is achieved by providing an article of footwear with a higher density peripheral portion. In particular, certain embodiments of the present invention provide areas of an article of footwear having greater density and greater support, and other areas having a lesser density, which are softer, and provide less support. This is highly advantageous since it allows the support provided in the article of footwear to be tailored to the type of activity that is often engaged in with a particular article of footwear. Thus, for example, an article of footwear designed for a basketball player can have a structure that is geared to enhance support for a user's foot in cutting maneuvers while an article of footwear designed for running can have a structure that is geared toward accommodating the heel strike to toe off impact profile encountered by a user's foot when running.

These and additional features and advantages of the invention disclosed here will be further understood from the following detailed disclosure of certain preferred embodiments.

Figure 1:
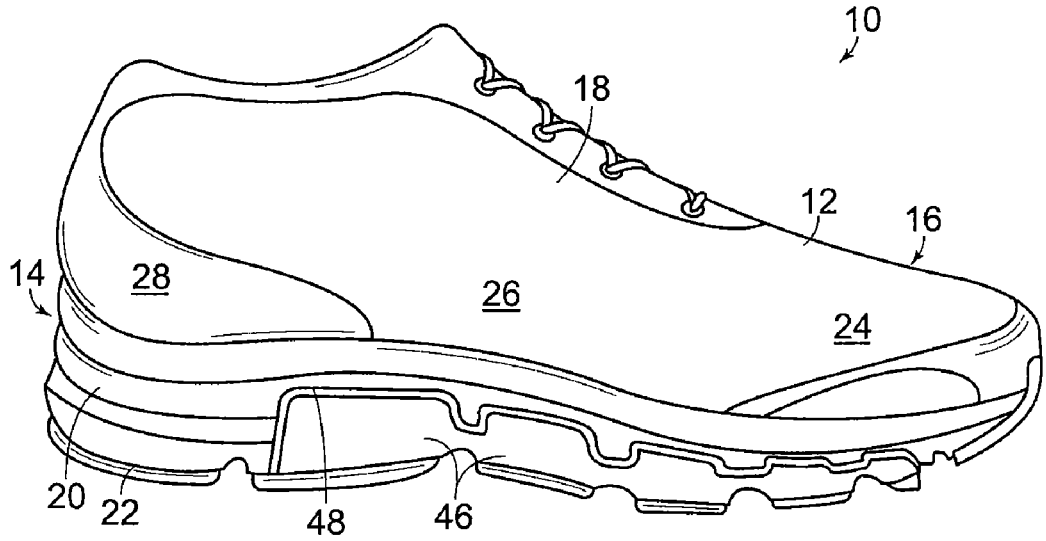
FIG. 1 is a lateral side view of an embodiment of an article of footwear.

The figures referred to above are not drawn necessarily to scale and should be understood to provide a representation of the invention, illustrative of the principles involved. Some features of the article of footwear depicted in the drawings have been enlarged or distorted relative to others to facilitate explanation and understanding. The same reference numbers are used in the drawings for similar or identical components and features shown in various alternative embodiments. Articles of footwear as disclosed herein would have configurations and components determined, in part, by the intended application and environment in which they are used.

DETAILED DESCRIPTION OF CERTAIN PREFERRED EMBODIMENTS

The present invention may be embodied in various forms. A preferred embodiment of an article of footwear 10 is shown in FIG. 1. Footwear 10 includes an upper 12 and a sole assembly 14 secured to upper 12. Sole assembly 14 may be secured to upper 12 by adhesive or any other suitable means. Footwear 10 has a medial, or inner, side 16 and a lateral, or outer, side 18.

Sole assembly 14, which is generally disposed between the foot of the wearer and the ground, provides attenuation of ground reaction forces (i.e., imparting cushioning), traction, and may control foot motions, such as pronation. As with conventional articles of footwear, sole assembly 14 may include an insole (not shown) located within upper 12, a midsole 20, and an outsole 22.

Midsole 20 is attached to upper 12 and functions as the primary shock-attenuating and energy-absorbing component of footwear 10. Midsole 20 may be secured to upper 12 by adhesive or other suitable means. Suitable materials for midsole 20 include polymer foam materials such as ethylvinylacetate or polyurethane, or any other material that compresses resiliently. Outsole 22 is attached to the lower surface of midsole 20 by adhesive or other suitable means. Suitable materials for outsole 22 include polymers, e.g., polyether-block co-polyamide polymers (sold as Pebax® by ATOFINA Chemicals of Philadelphia, Pa.), and nylon resins such as Zytel®, sold by Dupont. Other suitable materials for outsole 22 will become readily apparent to those skilled in the art, given the benefit of this disclosure. In certain embodiments, sole assembly 14 may not include an outsole layer separate from midsole 20 but, rather, the outsole may comprise a bottom surface of midsole 20 that provides the external traction surface of sole assembly 14.

For purposes of general reference, as illustrated here with respect to midsole 20, footwear 10 may be divided into three general portions: a forefoot portion 24, a midfoot portion 26, and a heel portion 28. Portions 24, 26, and 28 are not intended to demarcate precise areas of footwear 10. Rather, portions 24, 26, and 28 are intended to represent general areas of footwear 10 that provide a frame of reference during the following discussion.

Unless otherwise stated, or otherwise clear from the context below, directional terms used herein, such as rearwardly, forwardly, top, bottom, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 28, that is, to the left as seen in FIG. 1. Naturally, forwardly is toward forefoot portion 24, that is, to the right as seen in FIG. 1, and downwardly is toward the bottom of the page as seen in FIG. 1. Top refers to elements toward the top of the page as seen in FIG. 1, while bottom refers to elements toward the bottom of the page as seen in FIG. 1. Inwardly is toward the center of footwear 10, and outwardly is toward the outer peripheral edge of footwear 10.

Figure 3:
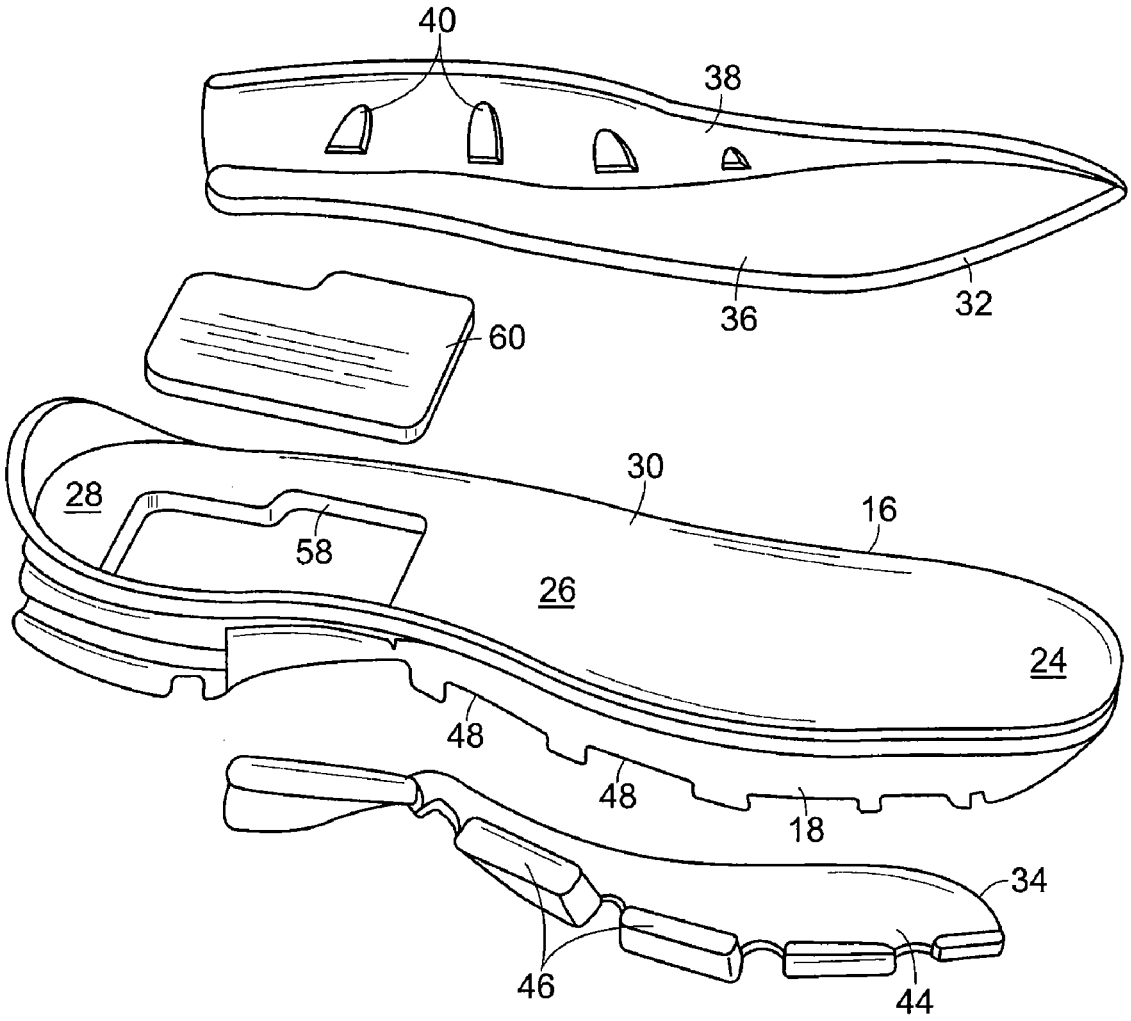
FIG. 3 is a perspective exploded view of the midsole of the article of footwear of FIG. 1.

Midsole 20 is shown in exploded form in FIG. 3. Midsole 20 includes a central member 30, a medial member 32 and a lateral member 34. Central member 30 extends from heel portion 28 to forefoot portion 24 of midsole 20. Medial member 32 extends along central member 30, and includes a first portion 36 that extends beneath a portion of central member 30, and a second portion 38 that extends along the medial side 16 of central member 30.

Central member 30 includes a first surface irregularity on its medial side that mates and interlocks with a corresponding surface irregularity on medial member 32. In the illustrated embodiment, medial member 32 includes at least one aperture 40 formed in second portion 38. Each aperture 40 receives a projection 42 (seen in FIG. 2) formed on central member 30, the engagement of projections 42 with apertures 40 helping interlock medial member 32 with central member 30.

In the illustrated embodiment, medial member 32 includes four apertures and central member includes four mating projections. However, it is to be appreciated that any number of mating apertures and projections can be provided. Further, it is to be appreciated that the projections may be formed on medial member 32 with mating apertures or recesses being formed in central member 30. The interlocking of medial member 32 and central member 30 need not necessarily require projections and mating apertures. Rather, the surface irregularities on medial member 32 and central member 30 that allow the interlocking of these two elements can be accomplished with any desired shape. The interlocking of the surface irregularities helps reduce the tendency of medial member 32 and central member 30 to move forward and backward with respect to one another, that is, away from forefoot portion 24 toward heel portion 28 and vice versa.

Lateral member 34 extends along central member 30, and includes a first portion 44 that extends beneath a portion of central member 30, and a second portion that extends along lateral side 18 of central member 30.

Central member 30 includes a second surface irregularity on its lateral side that mates and interlocks with a corresponding surface irregularity on lateral member 34. In the illustrated embodiment, the second portion of lateral member 34 is formed of a plurality of upwardly extending fingers 46. Each finger 46 is received in a corresponding recess 48 formed in lateral side 18 of central member 30, then engagement of fingers 46 with recesses 48 helping interlock lateral member 34 with central member 30.

In the illustrated embodiment, lateral member 34 includes five fingers and central member includes five mating recesses. However, it is to be appreciated that any number of mating fingers and recesses can be provided. Further, it is to be appreciated that the fingers may be formed on central member 30 with mating recesses being formed in lateral member 34. The interlocking of lateral member 34 and central member 30 need not necessarily require fingers and mating recesses. Rather, the surface irregularities on lateral member 34 and central member 30 that allow the interlocking of these two elements can be accomplished with any desired shape. The interlocking of the surface irregularities helps reduce the tendency of lateral member 34 and central member 30 to move forward and backward with respect to one another, that is, away from forefoot portion 24 toward heel portion 28 and vice versa.

Central member 30 is formed of a first material having a first stiffness and/or density. Medial member 32 is formed of a second material having a second stiffness and/or density, the stiffness and/or density of medial member 32 being greater than that of the first material. Lateral member 34 is also formed of a third material having a stiffness and/or density greater than the stiffness and/or density of the first material. In certain embodiments, medial member 32 and lateral member 34 are formed of the same material.

In certain embodiments, central member 30, medial member 32 and lateral member 34 may be formed of ethyl vinyl acetate (EVA), with the stiffness and/or density of the EVA of medial member 32 and lateral member 34 being greater than that of central member 30. In certain embodiments, the first material used to form central member 30 is a compression molded material. In certain embodiments, the second material used to form medial member 32 and lateral member 34 is an injection molded material.

The material used to form central member 30, medial member 32 and/or lateral member 34 may also be polyurethane, for example. Other suitable materials for use in forming central member 30, medial member 32 and lateral member 34 will become readily apparent to those skilled in the art, given the benefit of this disclosure.

The greater stiffness and/or density of medial member 32 and lateral member 34 provides greater support for the user's foot than that provided by central member 30. This allows the lateral stability of footwear 10 to be customized, or optimized, for particular activities or foot constructions. Footwear 10, therefore, promotes correct kinematic activity for the user's foot through optimized placement and sizing of medial member 32 and lateral member 34 with respect to central member 30.

Figure 2:
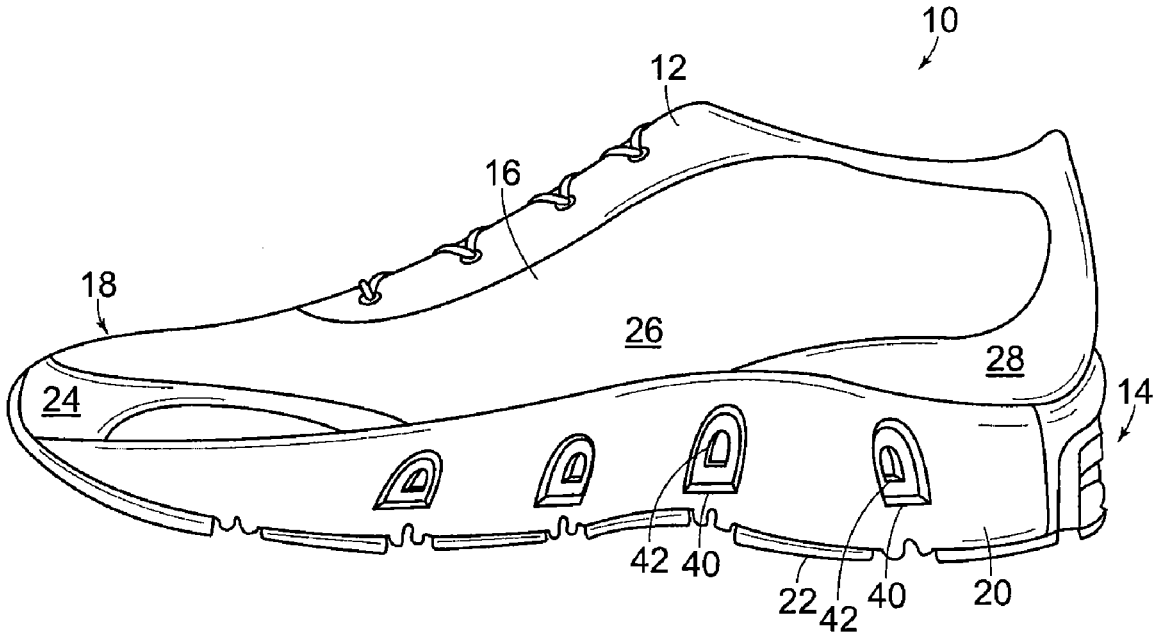
FIG. 2 is a medial side view of the article of footwear of FIG. 1.

The embodiment illustrated in FIGS. 1-3 may be suitable, for example, in a running shoe. With many individuals, the typical motion of the foot during running proceeds as follows: First, the heel strikes the ground, followed by the ball of the foot. As the heel leaves the ground, the foot rolls forward such that the toes make contact, and finally the entire foot leaves the ground during toe-off, or launch to begin another cycle. While in contact with the ground, the foot typically rolls from the outside or lateral side to the inside or medial side, a process called pronation. That is, normally the outside of the heel strikes first and the toes on the inside of the foot leave the ground last. While the foot is airborne and preparing for another cycle, the opposite process, called supination, occurs. As the heel lifts, the foot rolls forward such that the toes make contact until launch when the foot leaves the ground to begin another cycle.

In the embodiment illustrated in FIGS. 1-3, medial member 32 extends from a rear portion of heel portion 28 to a front portion of forefoot portion 24. Lateral member 34, on the other hand, extends only from a rear of midfoot portion 26 to a central portion of forefoot portion 24. Thus, medial member 32 is longer than lateral member 34 and, therefore, provides more support for the user's foot on medial side 16 of footwear 10, thereby reducing the effects of pronation.

Figure 4:
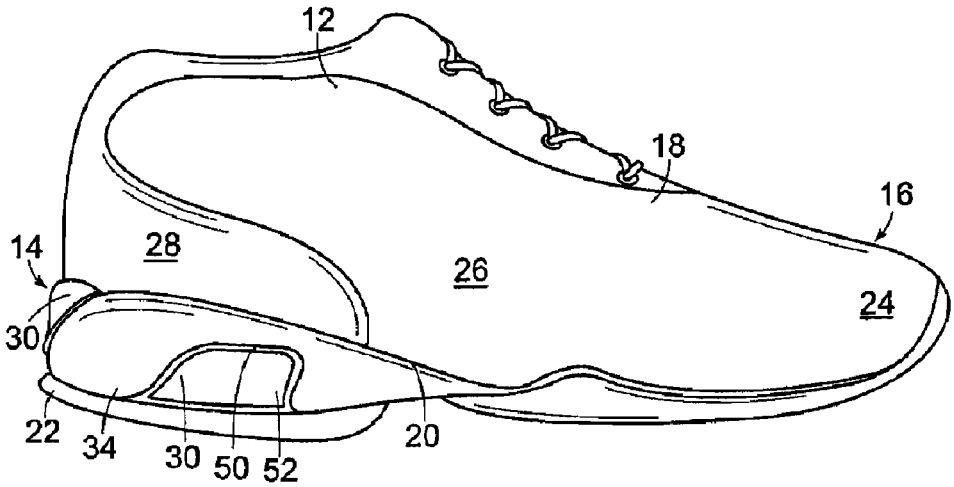
FIG. 4 is a lateral side view of another embodiment of an article of footwear.
Figure 5:
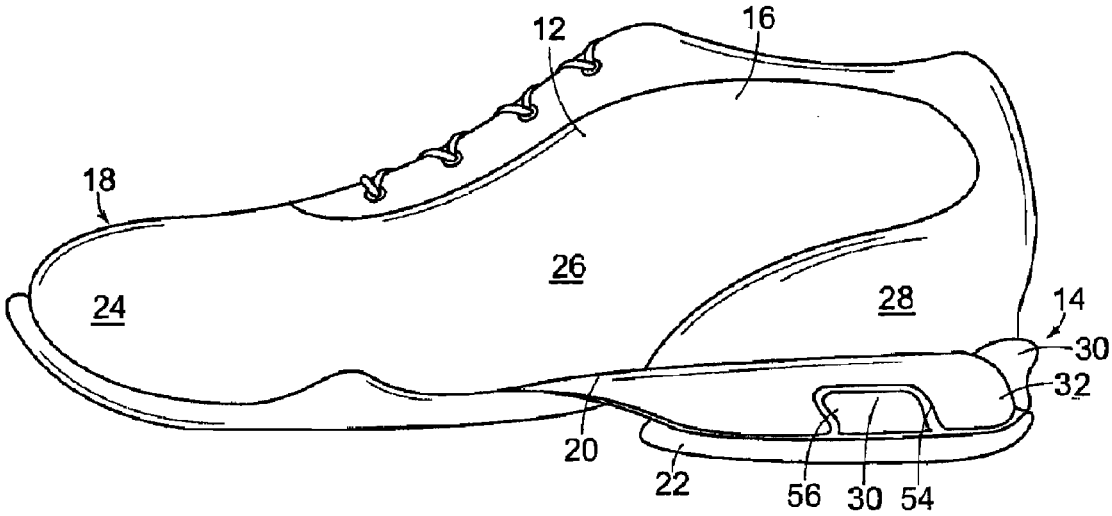
FIG. 5 is a medial side view of the article of footwear of FIG. 4.

In another embodiment, illustrated in FIGS. 4-5, each of medial member 32 and lateral member 34 extends from a rear portion of heel portion 28 to a central portion of midfoot portion 26, each having a portion (not shown) extending beneath central member 30 and a portion extending along a respective side of central member 30. Lateral member 34 includes a recess 50 that receives a projection 52 formed on central member 30. The engagement of projection 52 with recess 50 helps interlock lateral member 34 with central member 30. Similarly, medial member 32 includes a recess 54 that receives a projection 56 formed on central member 30. The engagement of projection 56 with recess 54 helps interlock medial member 32 with central member 30.

It is to be appreciated that although the embodiment illustrated in FIGS. 4-5 shows medial member 32 and lateral member 34 having a single projection that is received in a single recess in central member 30, medial member 32 and lateral member 34 could have any number of recesses configured to receive projections of central member 30. Additionally, it is to be appreciated that medial member 30 and lateral member 34 could have projections with central member having corresponding recesses or apertures that receive the projections.

In certain embodiments, as seen in FIG. 3, a recess 58 is formed in an upper surface of central member 30. A fluid-filled bladder 60 is received in recess 58, providing additional support for the user's foot. Fluid-filled bladder 60 may be filled with air or any other suitable fluid.

The embodiment illustrated in FIGS. 4-5, where medial member 32 and lateral member 34 are approximately the same size, i.e., the same length, width and height, may be suitable for cross-training, in which the movements of the user's foot are extremely varied, in contrast with an activity, such as running, in which the user's foot is subject to the same forces repeatedly. In an embodiment designed for use where a lot of lateral cutting is involved, e.g., basketball, lateral member 34 would be larger than medial member 32, allowing the medial side 16 of footwear 10 to collapse more easily to accommodate the lateral cuts performed by the user.

The width or thickness of medial member 32 and lateral member 34 can also be varied in one or more locations, with the width of central member 30 varying in accordance with the width or thickness of medial member 32 and lateral member 34, thereby altering the support provided for the user's foot.

The amount and location of the support provided for the user's foot can easily be varied by altering the location and size of medial member 32 and lateral member 34, as well as the size of central member 30. Consequently, footwear 10 can thus be configured to compensate for the peak pressures encountered by the user's foot in a particular activity, e.g., running, basketball, cross-training, tennis, etc. Footwear 10 can also be configured to compensate for the configuration of a particular user or group of users.

It is to be appreciated that central member 30 can be manufactured with a color different from that of medial member 32 and/or lateral member 34, providing a desired aesthetic appearance for footwear 10.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. An article of footwear comprising, in combination:

an upper;

a sole assembly secured to the upper and comprising:

a central member formed of a first material having a first density, a medial side of the central member having a first surface irregularity, a lateral side of the central member having a second surface irregularity;

a medial member extending along a portion of the medial side of the central member and extending only partially beneath a portion of the central member and having a surface irregularity configured to mate and interlock with the first surface irregularity of the central member, the medial member being formed of a second material having a density greater than the first density; and a lateral member extending along a portion of the lateral side of the central member and extending only partially beneath a portion of the central member and having a surface irregularity configured to mate and interlock with the second surface irregularity of the central member, the lateral member being formed of the second or a third material having a density greater than the first density.

2. The article of footwear of claim 1, wherein the second material and the third material are the same material.

3. The article of footwear of claim 1, wherein a length of the lateral member is longer than a length of the medial member.

4. The article of footwear of claim 1, wherein a length of the medial member is longer than a length of the lateral member.

5. The article of footwear of claim 1, wherein the first material is ethyl vinyl acetate.

6. The article of footwear of claim 1, wherein the second material is ethyl vinyl acetate.

7. The article of footwear of claim 1, wherein the first material is a compression molded material.

8. The article of footwear of claim 1, wherein the second material is an injection molded material.

9. The article of footwear of claim 1, wherein the central member, lateral member and medial member comprise a midsole.

10. The article of footwear of claim 9, further comprising an outsole secured to the midsole.

11. The article of footwear of claim 1, wherein the surface irregularity of the medial member comprises at least one aperture.

12. The article of footwear of claim 11, wherein the first surface irregularity of the central member comprises at least one projection, each projection being received in a corresponding aperture in the medial member.

13. The article of footwear of claim 1, wherein the second surface irregularity of the central member comprises at least one recess and the surface irregularity of the lateral member comprises at least one upwardly extending finger, each recess receiving a corresponding finger.

14. The article of footwear of claim 1, wherein the first surface irregularity of the central member comprises an upwardly extending finger and the surface irregularity of the medial member comprises a recess, the upwardly extending finger of the central member being received in the recess of the medial member.

15. The article of footwear of claim 1, wherein the second surface irregularity of the central member comprises an upwardly extending finger and the surface irregularity of the lateral member comprises a recess, the upwardly extending finger of the central member being received in the recess of the lateral member.

16. The article of footwear of claim 1, further comprising:

a recess formed in an upper surface of the central member; and a fluid-filled bladder, the fluid-filled bladder being received in the recess in the upper surface of the central member.

17. An article of footwear comprising, in combination:

an upper;

a sole assembly secured to the upper and comprising:

a midsole comprising:

a central member formed of a first material having a first density, a medial side of the central member having a first surface irregularity, and a lateral side of the central member having a second surface irregularity;

a medial member extending along the medial side of the central member and extending only partially beneath a portion of the central member and having a surface irregularity configured to mate and interlock with the first surface irregularity of the central member, the medial member formed of a second material having a second density, the second density being greater than the first density; and a lateral member extending along the lateral side of the central member and extending only partially beneath a portion of the central member and having a surface irregularity configured to mate and interlock with the second surface irregularity of the central member, the lateral member being formed of the second or a third material, having a higher density than the first material; and an outsole secured to the midsole.

18. The article of footwear of claim 17, wherein the surface irregularity of the medial member comprises at least one aperture and the first surface irregularity of the central member comprises at least one projection, each aperture receiving a corresponding projection.

19. The article of footwear of claim 17, wherein the second surface irregularity of the central member comprises at least one recess and the surface irregularity of the lateral member comprises at least one upwardly extending finger, each recess receiving a corresponding finger.

20. The article of footwear of claim 17, wherein the first surface irregularity of the central member comprises an upwardly extending finger and the surface irregularity of the medial member comprises a recess, the upwardly extending finger of the central member being received in the recess of the medial member.

21. The article of footwear of claim 17, wherein the second surface irregularity of the central member comprises an upwardly extending finger and the surface irregularity of the lateral member comprises a recess, the upwardly extending finger of the central member being received in the recess of the lateral member.

22. The article of footwear of claim 17, further comprising:

a recess formed in an upper surface of the central member; and a fluid-filled bladder, the fluid-filled bladder being received in the recess in the upper surface of the central member.

23. An article of footwear comprising, in combination:

an upper;

a sole assembly secured to the upper and comprising:

a midsole comprising:

a central member formed of ethyl vinyl acetate and having a first density, a medial side of the central member having a first surface irregularity, a lateral side of the central member having a second surface irregularity;

a medial member extending along a medial side of the central member and extending only partially beneath a portion of the central member and having a surface irregularity configured to mate and interlock with the first surface irregularity of the central member, the medial member being formed of a material having a second density, the second density being greater than the first density;

a lateral member extending along a lateral side of the central member and extending only partially beneath a portion of the central member and having a surface irregularity configured to mate and interlock with the second surface irregularity of the central member, the lateral member being formed of a material having the second density, the second density being greater than the first density;

a recess formed in an upper surface of the central member; and a fluid-filled bladder received in the recess in the central member; and an outsole secured to the midsole.

* * * * *